US006290059B1

(12) United States Patent
Chuan

(10) Patent No.: US 6,290,059 B1
(45) Date of Patent: Sep. 18, 2001

(54) RETRACTABLE CIGAR RECEIVING TUBE

(76) Inventor: Chin-Chung Chuan, No. 183, Sec. 2, Shu-Lin St., Tainan City (TW)

( * ) Notice: Subject to any disclaimer, the term of this patent is extended or adjusted under 35 U.S.C. 154(b) by 0 days.

(21) Appl. No.: 09/541,658

(22) Filed: Apr. 3, 2000

(51) Int. Cl.[7] ..... B65D 69/00
(52) U.S. Cl. ..... 206/238; 220/8; 206/270
(58) Field of Search ..... 206/446, 244, 206/248, 266, 267, 270, 303, 236, 238, 239, 240, 537; 220/8, 600

(56) References Cited

U.S. PATENT DOCUMENTS 2,372,800 * 4/1945 Stearns ..... 220/8
2,416,142 * 2/1947 Bennett ..... 220/8
3,659,108 * 4/1972 Quase ..... 220/8
4,000,812 * 1/1977 Pisarski et al. ..... 206/270
4,046,279 * 9/1977 Rosler ..... 220/8
4,210,253 * 7/1980 Rosler ..... 220/8
4,487,327 * 12/1984 Grayson ..... 220/8
4,562,979 * 1/1986 Taylor ..... 220/8
4,596,340 * 6/1986 Luther ..... 220/8
5,605,242 * 2/1997 Hwang ..... 220/8

* cited by examiner

*Primary Examiner*—Shian Luong
(74) *Attorney, Agent, or Firm*—Charles E. Baxley

(57) ABSTRACT

A cigar receiving tube includes a first tube having two open ends and each open end has a protrusion extending radially outward from an outside thereof. Two second tubes are respectively movably mounted to the tow open ends of the first tube and a collar extends radially inward from an inside of a first end of each of the two second tubes to prevent the second tubes from being separated from the first tube when pulling the second tubes. Each second tube has a cap mounted thereto so that the length of the cigar receiving tube can be adjusted according to the length of the cigar to be received in the cigar tube.

6 Claims, 8 Drawing Sheets

RETRACTABLE CIGAR RECEIVING TUBE

FIELD OF THE INVENTION

The present invention relates to a receiving tube for receiving a cigar therein and the tube includes three sections so as to be retractably combined according to length of the cigar to be received in the tube.

BACKGROUND OF THE INVENTION

A conventional cigar tube is shown in FIG. 8 and generally includes a body 10 having a closed bottom and an open top, and a cap 11 which is removably mounted to the open top of the body 10. A cigar can be received in the body 10 and the cap 11 is mounted to the body 10 to prevent the cigar from being accessed by dust and moisture. The conventional cigar tube is simply a tube that has a fixed size. In order to let the user to receive the cigar with different length, manufacturers usually make the cigar tube as large as possible so that a small cigar can be received. It is obvious that when a cigar with small size is received in the cigar tube, the cigar is not well positioned in the tube so that it will impact an inside of the tube and will be deformed.

The present invention intends to provide a cigar tube that has a feature of changing its length so that the cigar in the tube can be well positioned.

SUMMARY OF THE INVENTION

In accordance with one aspect of the present invention, there is provided a cigar receiving tube and comprising a first tube having an open end with a protrusion extending radially outward from an outside of the open end. A second tube is movably mounted to the open end of the first tube and a collar extends radially inward from an inside of a first end of the second tube so that the collar may contact the protrusion when the second tube is slid away from the first tube to adjust the length of the cigar receiving tube.

The object of the present invention is to provide a cigar receiving tube that has a first tube and two second tubes respectively and movably mounted to two ends of the first tube so that the second tubes can be slid relative to the first tube to adjust the length of the cigar receiving tube.

Another object of the present invention is to provide a cigar receiving tube that includes a lighter and/or a knife means connected thereto.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
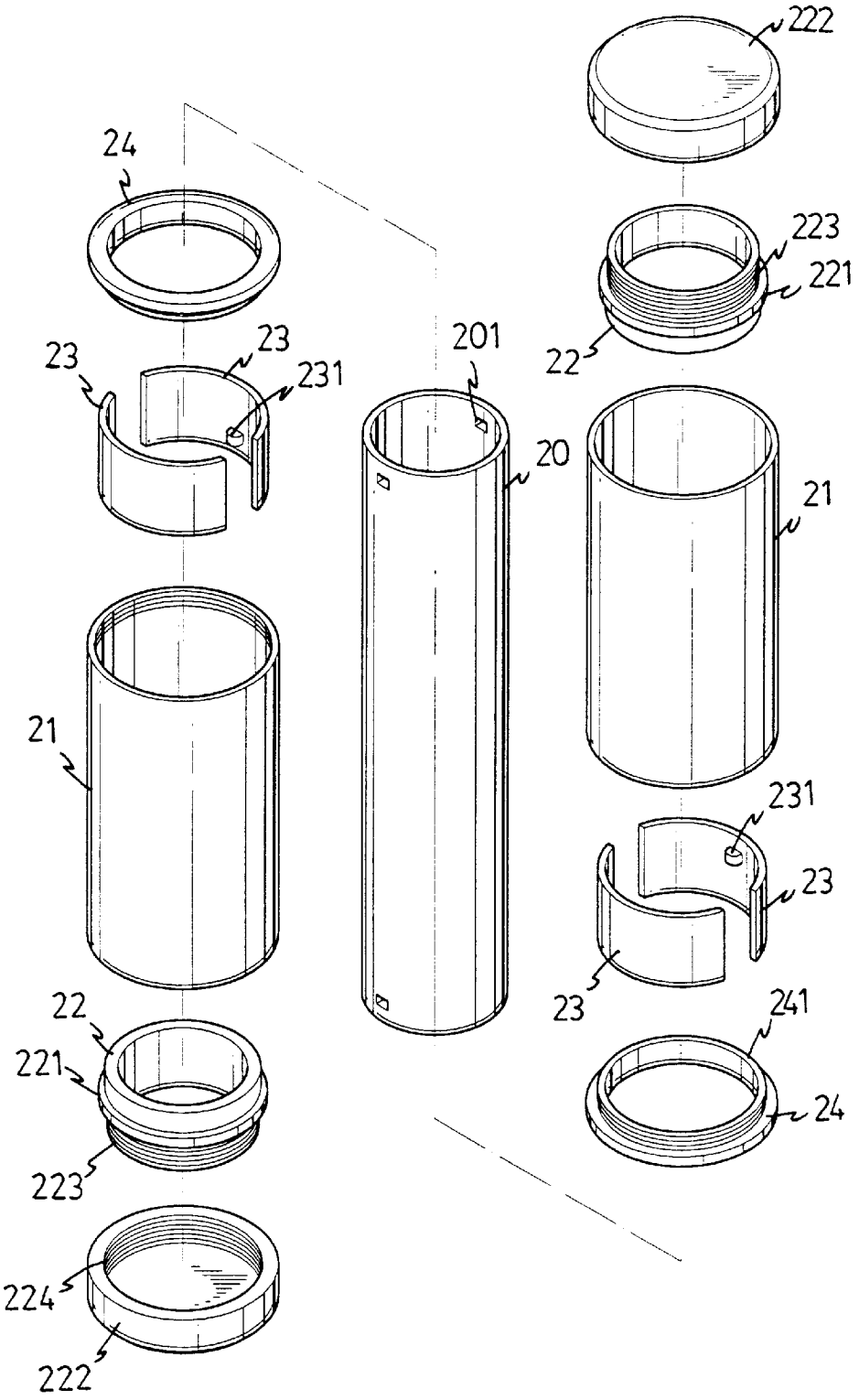
FIG. 1 is an exploded view to show a cigar receiving tube in accordance with the present invention.
Figure 2:
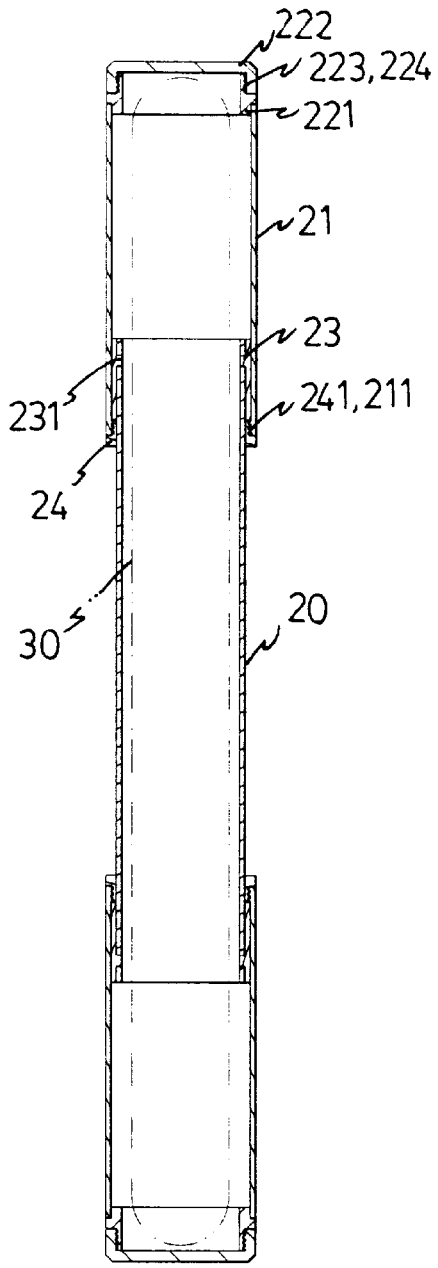
FIG. 2 is a side elevational view, partly in section, of the cigar receiving tube of the present invention.

Referring to FIGS. 1 and 2, a cigar receiving tube in accordance with the present invention comprises a first tube 20 having two open ends and two apertures 201 are defined radially through each of the open ends of the first tube 20. Two pairs of semi-circular-shaped partition 23 and each partition has a boss 231 extending from an inside thereof. Each pair of the partition 23 are mounted to an outside of each open end of the first tube 20 with the two respective bosses 231 being engaged with the two apertures 201 in each open end of the first tube 20. Therefore, the two pairs of partitions 23 perform as a protrusion 23 extending radially outward from an outside of each the open end of the first tube 20.

Two second tubes 21 each have an threaded inner portion 211 on a first end thereof and the two second tubes 21 are respectively movably mounted to the two open ends of the first tube 20. The partitions 23 are respectively located between the first tube 20 and the second tubes 21. A collar 241 is threadedly engaged with threaded inner portion 211 on the first end of each second tube 21 and a flange 24 extends radially outward from each collar 241. The flange 24 is engaged with the first end of the second tube 21. The collars 241 may respectively contact the partitions 23 when the second tube 21 is slid away from the first tube 20 so that the two second tubes 21 will not be separated from the first tube 20.

Figure 3:
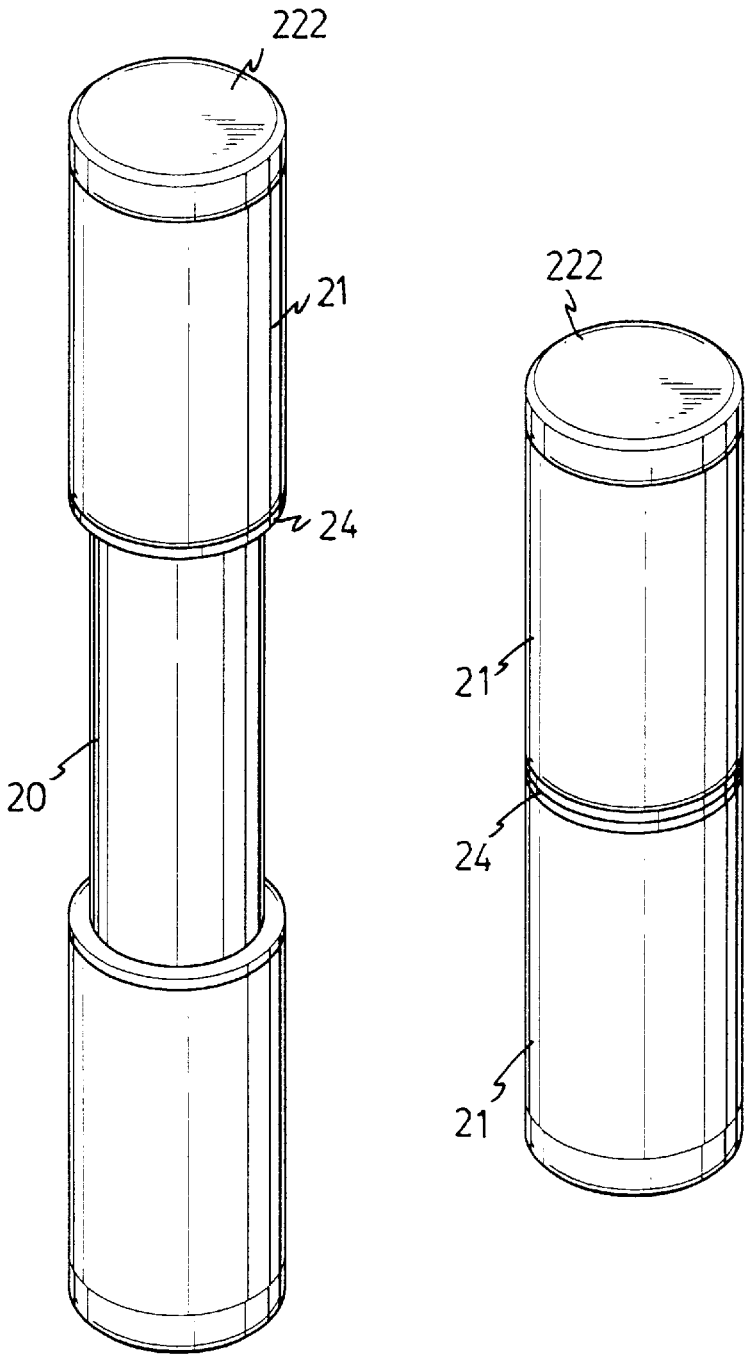
FIG. 3 is a perspective view to show two different statuses of the cigar receiving tube of the present invention.

A second end of each second tube 21 is an open end and a ring member 22 is engaged with the second end of the second tube 21. The ring member 22 has a threaded neck 223 extending therefrom and a cap 222 is threadedly engaged with the threaded neck 223. A cigar 30 can be received in the cigar receiving tube from either end of the cigar receiving tube by removing the cap 222. As shown in FIG. 3, the second tubes 21 can be pushed toward each other to shorten the length of the cigar receiving tube so as to receive a short cigar.

Figure 4:
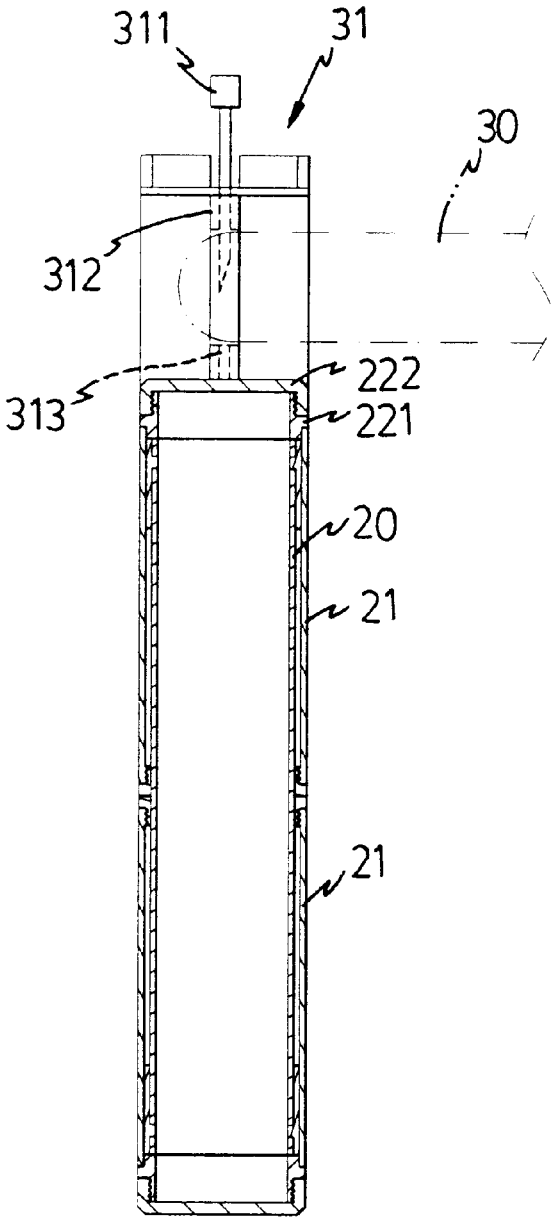
FIG. 4 is a side elevational view, partly in section, of the cigar receiving tube of the present invention, wherein a knife means is connected to an end of the cigar receiving tube.
Figure 5:
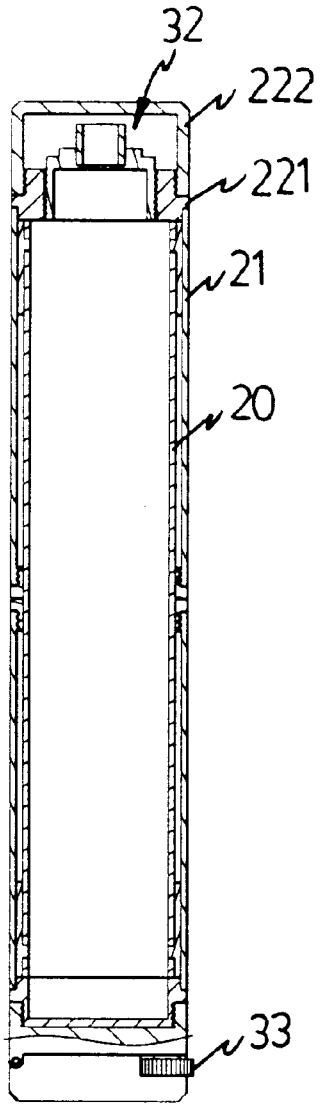
FIG. 5 is a side elevational view, partly in section, of the cigar receiving tube of the present invention, wherein another knife means is connected to an end of the cigar receiving tube.
Figure 6:
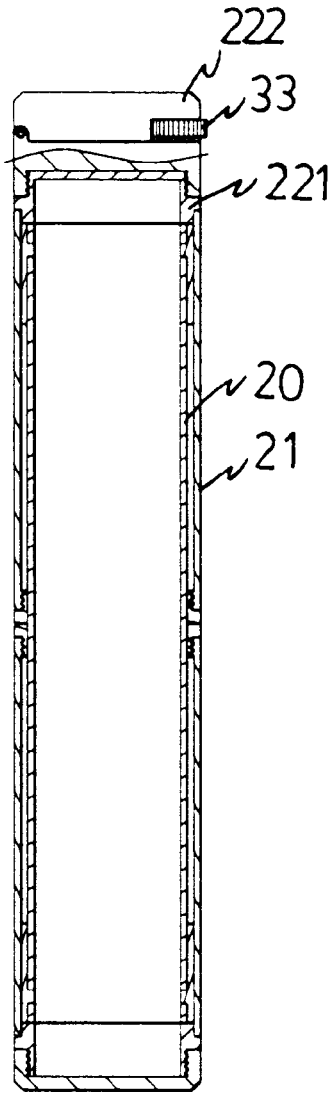
FIG. 6 is a side elevational view, partly in section, of the cigar receiving tube of the present invention, wherein a lighter is connected to an end of the cigar receiving tube.

As shown in FIG. 4, a cigar knife means 31 can be connected to one of the caps 222. The cigar knife means 31 includes a passage 312 defined longitudinally in the knife means 31 and a knife 311 is movably received in the passage 312. A knife receiving gap 313 is defined in an inner end of the knife means 31 to receive the knife 311 when the knife 311 is pushed to cut a cigar 30 radially inserted into the cigar knife means 31. FIG. 5 shows another type of cigar knife means 32 which is engaged with an inside of one of the ring members 22 and is enclosed by the cap 222 mounted to the ring member 22. The other end of the cigar receiving tube has a lighter 33 connected thereto. Of course, the lighter 33 may also be located in the cap 222 and the striker wheel extends from the cap 222.

Figure 7:
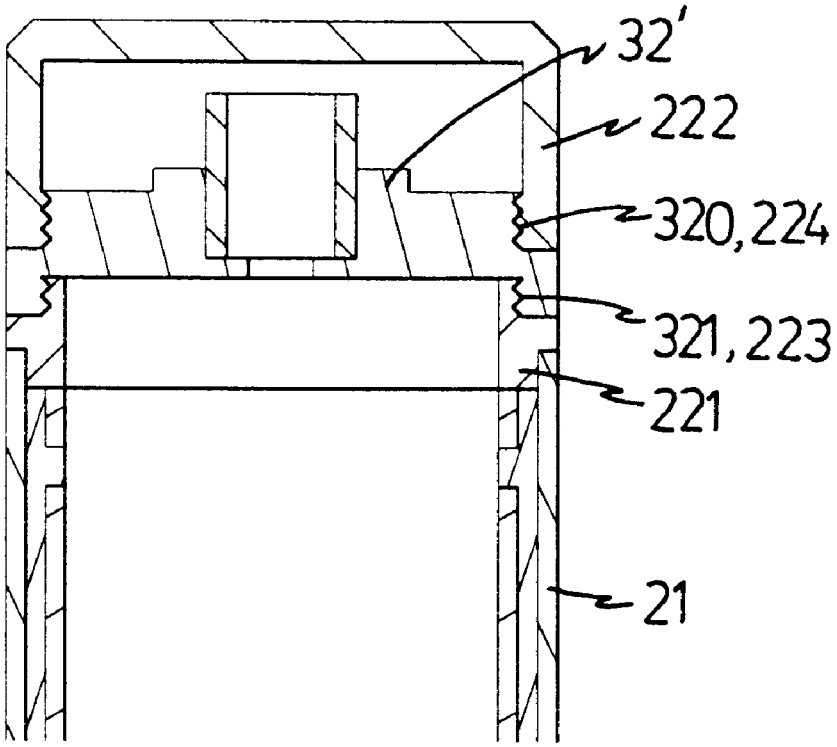
FIG. 7 is a side elevational view, partly in section, of an combination of the cigar receiving tube of the present invention and yet another knife means.
Figure 8:
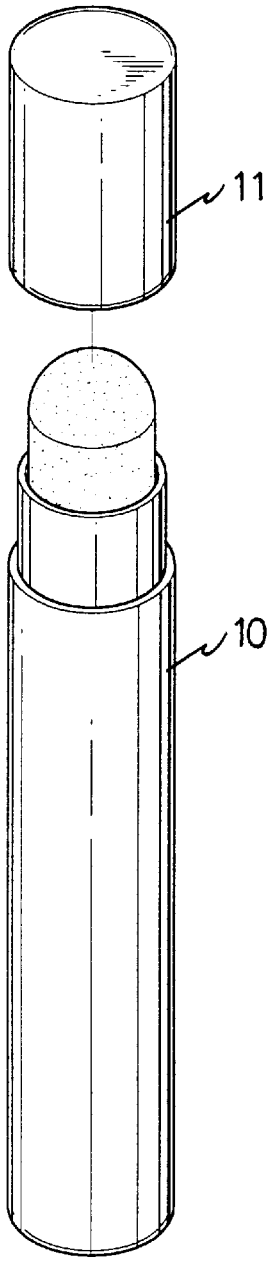
FIG.8 PRIOR ART
FIG. 8 is an exploded view to show a conventional cigar receiving tube.

FIG. 7 shows yet another type of cigar knife means 32' which has an outside threaded periphery 320 for being engaged with a threaded inside 224 (see FIG. 1) of the cap 222 and an inside threaded periphery 321 for being engaged with the threaded neck 223 of the ring member 22.

By the cigar receiving tube, any length of a cigar can be well received and positioned in the cigar receiving tube. The lighter 33 and/or the knife means 32 may be connected to the cigar receiving tube so that the present invention is convenient for the users.

While we have shown and described various embodiments in accordance with the present invention, it should be clear to those skilled in the art that further embodiments may be made without departing from the scope and spirit of the present invention.

What is claimed is:

1. A cigar receiving tube comprising:

a first tube having an open end and a protrusion extending radially outward from an outside of said open end of said first tube, two apertures defined radially through said first tube and said protrusion including two partitions, each partition having a boss, extending from an inside thereof so that said two respective bosses are engaged with said two apertures, and a second tube movably mounted to said open end of said first tube and a collar extending radially inward from an inside of a first end of said second tube, said protrusion located between said first tube and said second tube, said collar contacting said protrustion when said second tube is slid away from said first tube.

2. The cigar receiving tube as claimed in claim 1, wherein said collar is threadedly engaged with said second tube.

3. The cigar receiving tube as claimed in claim 2 further comprising a flange extending radially outward from said collar and said flange engaged with said first end of said second tube.

4. A cigar receiving tube comprising:

a first tube having an open end and a protrusion extending radially outward from an outside of said open end of said first tube, and a second tube movably mounted to said open end of said first tube and a collar extending radially inward from an inside of a first end of said second tube, said protrusion located between said first tube and said second tube, said collar contacting said protrusion when said second tube is slid away from said first tube, a second end of said second tube being an open end and a ring member engaged with said second end of said second tube, said ring member having a threaded neck extending therefrom and a cap threadedly engaged with said threaded neck.

5. The cigar receiving tube as claimed in claim 4 further comprising a cigar knife means engaged with an inside of said ring member.

6. The cigar receiving tube as claimed in claim 4 further comprising a cigar knife means which has an outside threaded periphery for being engaged with said cap and an inside threaded periphery for being engaged with said ring member.

* * * * *